US006799890B2

(12) United States Patent
Schneider et al.

(10) Patent No.: US 6,799,890 B2
(45) Date of Patent: Oct. 5, 2004

(54) TAMPER EVIDENT RESEALABLE PACKAGING

(75) Inventors: John H. Schneider, Frankfort, IL (US); Donald L. Crevier, Essex, IL (US); Steven Ausnit, New York, NY (US); Michael McMahon, Palatine, IL (US); Lawrence Share, Skokie, IL (US); Eric P. Plourde, Homewood, IL (US); Robert E. Hogan, Burr Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/336,964

(22) Filed: Jan. 6, 2003

(65) Prior Publication Data

US 2003/0099412 A1 May 29, 2003

Related U.S. Application Data

(62) Division of application No. 09/761,500, filed on Jan. 16, 2001.

(51) Int. Cl.[7] ..... B65D 33/16

(52) U.S. Cl. ..... 383/210; 383/61.2; 383/203; 383/64; 383/5

(58) Field of Search ..... 383/61.2, 210, 383/211, 64, 203, 5; 24/399, 400; 53/412; 493/213

(56) References Cited

U.S. PATENT DOCUMENTS

| | | | | |
|---|---|---|---|---|
| 4,925,316 | A | | 5/1990 | Van Erden et al. |
| 5,023,122 | A | | 6/1991 | Boeckmann et al. |
| 5,224,779 | A | | 7/1993 | Thompson et al. |
| 5,470,156 | A | | 11/1995 | May |
| 5,474,382 | A | | 12/1995 | May |
| 5,486,051 | A | | 1/1996 | May |
| 5,492,411 | A | | 2/1996 | May |
| 5,509,735 | A | | 4/1996 | May |
| 5,513,915 | A | | 5/1996 | May |
| 5,551,127 | A | | 9/1996 | May |
| 5,604,000 | A | | 2/1997 | May |
| 5,660,479 | A | | 8/1997 | May et al. |
| 5,669,174 | A | | 9/1997 | Teetzel |
| 5,669,715 | A | | 9/1997 | Dobreski et al. |
| 5,672,009 | A | | 9/1997 | Malin |
| 5,713,669 | A | | 2/1998 | Thomas et al. |
| 5,725,312 | A | | 3/1998 | May |
| 5,827,163 | A | | 10/1998 | Kettner |
| 5,964,532 | A | | 10/1999 | St. Phillips et al. |
| 6,000,197 | A | * | 12/1999 | Ausnit ..... 53/412 |
| 6,065,872 | A | | 5/2000 | Johnson |
| 6,212,857 | B1 | * | 4/2001 | Van Erden ..... 53/412 |
| 6,412,254 | B1 | * | 7/2002 | Tilman et al. ..... 53/412 |
| 6,505,383 | B2 | * | 1/2003 | Machacek et al. ..... 24/30.5 R |

FOREIGN PATENT DOCUMENTS

| | | |
|---|---|---|
| EP | 0 959 013 | 11/1999 |
| NZ | 242959 | 10/1994 |
| NZ | 250690 | 5/1996 |
| WO | 99/62781 | 12/1999 |
| WO | WO 01/32521 A1 | 5/2001 |

* cited by examiner

*Primary Examiner*—Jes F. Pascua
(74) *Attorney, Agent, or Firm*—Pitney Hardin LLP

(57) ABSTRACT

A reclosable package has a first wall and a second wall opposite to the front wall A first zipper profile including a first interlocking member is attached to the first wall and a second profile having a second interlocking member, engageable with the first interlocking member, is attached to the second wall. A slider is positioned on the profiles for movement along the profiles from side to side of the package. Package material is provided which must be removed or ruptured to permit operation of the slider or to provide access to the package contents. In either event, the steps needed to permit the initial access to the package contents leave clear evidence for a consumer that the package has been opened.

2 Claims, 6 Drawing Sheets

TAMPER EVIDENT RESEALABLE PACKAGING

CROSS REFERENCE TO RELATED APPLICATIONS

This is a division of U.S. patent application Ser. No. 09/761,500 filed on Jan. 16, 2001.

BACKGROUND OF THE INVENTION

The present invention relates to reclosable packaging and in particular to such packaging wherein indicia is provided to indicate the first opening of the package.

Zipper packaging is becoming more and more prevalent as the primary packaging for foodstuffs and other consumer products. Such packages readily lend themselves to being opened by the consumer and reclosed after some portion of the package is removed, rendering the remainder of the package contents readily storable in the original package. Unfortunately the zipper alone does not afford protection against potential tampering with the package contents and hence the need has arisen for manufacturers to provide on such zipper packaging tamper evidence to alert the consumer to a first opening of the package. Such tamper evidence discourages potential tampering of the product prior to sale and alerts the consumer if the package has already been opened, regardless of whether the zipper is open or closed. The problem of providing a tamper evident zipper is exacerbated where the zipper is to be provided with a slider. While a slider facilitates a consumer opening and reclosing the package and hence is desirable in some instances, the slider makes it difficult for the manufacturer to employ conventional techniques to render the package tamper evident.

SUMMARY OF THE INVENTION

In view of the above, it is a principal object of the present invention to provide an improved zipper package construction which requires some permanent change of the package appearance to enable the first opening of the package by the purchaser of the package.

A further object is to provide such a package wherein the package is "user friendly" in that the steps necessary for the initial opening of the package prior to the use of the zipper must be obvious or intuitive to the consumer.

A still further object is to provide a package that may be formed on conventional packaging equipment with little or no modification of the equipment required.

Still another object is to provide, in cases where the zipper packaging includes a slider, a tamper evident feature that is compatible with the slider being present. Similarly, where the package contents require hermetic sealing, it is desirable that the tamper evident feature also permit such hermetic sealing.

The above and other objects and advantages are attained in accordance with the present invention by providing a reclosable packaging having a first wall and a second wall opposite to the front wall. A first zipper profile including a first interlocking member is attached to the first wall and a second profile having a second interlocking member, engageable with the first interlocking member, is attached to the second wall. A slider is positioned on the profiles for movement along the profiles from side to side of the package. The slider serves to disengage the profile interlocking members when moved in the direction of the closing end of the slider and to engage the profile interlocking members when moved in the direction of the opening end of the slider.

In accordance with the present invention the slider is either contained within or blocked from movement along the profile interlocking members by package material which must be removed or ruptured to permit operation of the slider or to provide access to the package contents. In either event, the steps needed to permit the initial access to the package contents leave clear evidence for a consumer that the package has been opened.

In a first embodiment of the invention, portions of the package walls extend over and about the slider and must be removed or ruptured to provide access to the slider. The portions may comprise extensions of the package wall material or may comprise portions of the zipper profiles.

In a second embodiment, a web of material extends across the package below the zipper profiles' interlocking members. The web may be connected to the package walls or to flanges of one or both of the zipper profiles.

In a third embodiment a header is added to the package enclosing the profiles' interlocking members and the slider. For a consumer to obtain access to the slider the header must be removed or ruptured.

In a fourth embodiment flanges of one or both of the zipper profiles are used to encapsulate the package contents, either above or below the profiles' interlocking members.

In a fifth embodiment the zipper slider is constrained from movement along the profiles by a strip of material or a flap that must be removed before the slider can be moved from its initial closed position to an open position.

In each of the above cases, the steps that must be taken before the initial opening of the package results in a physical altering of the sealed package which may readily be observed by a consumer.

DETAILED DESCRIPTION OF THE PREFERRED EMBODIMENTS

Figures 1, 2, 3, 4, 5, 6:
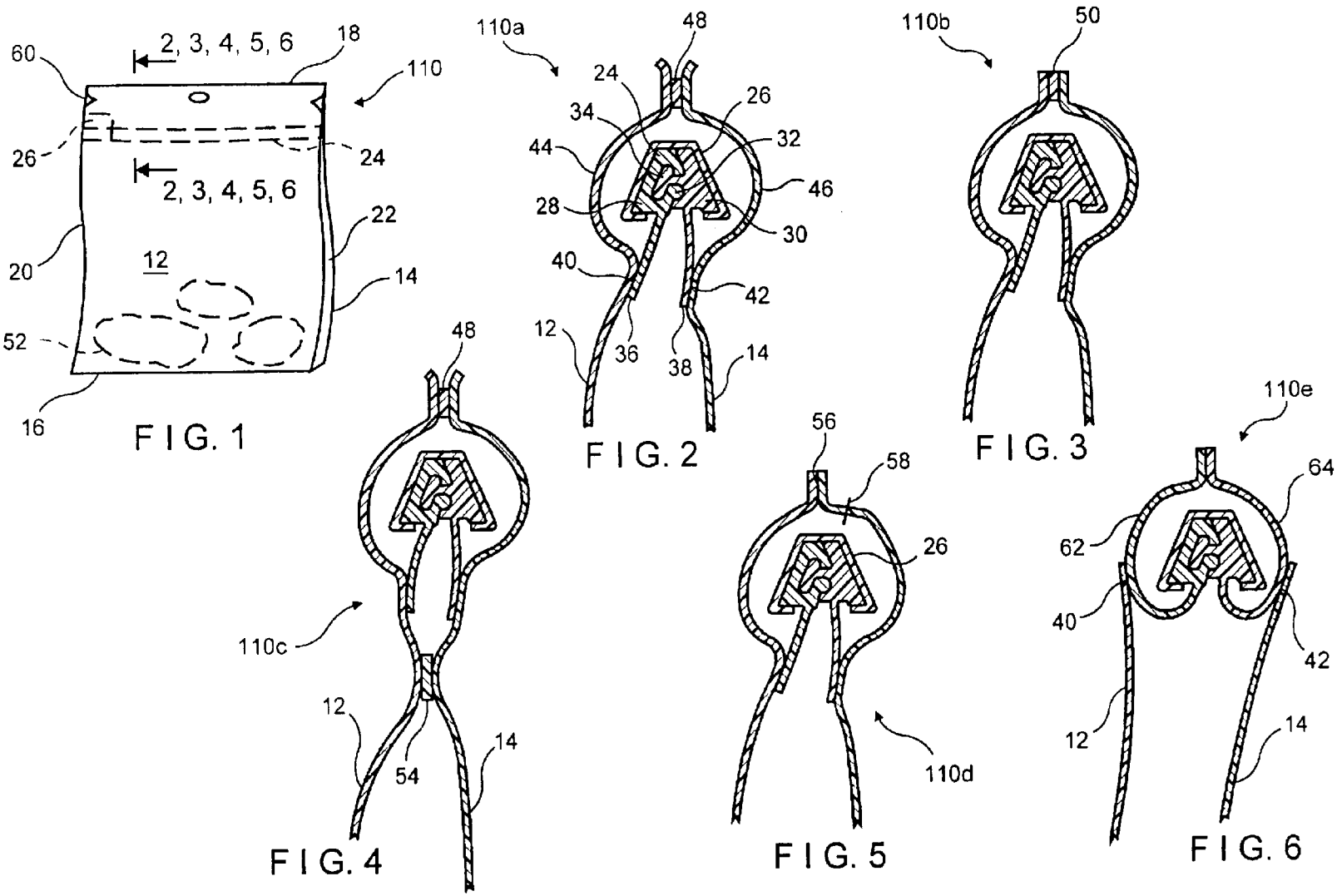
FIG. 1 is a front perspective view of a first embodiment of a package in accordance with the present invention.
FIGS. 2–6 are alternative fragmentary sectional views taken off FIG. 1 in the direction indicated by the arrows.
Figure 9:
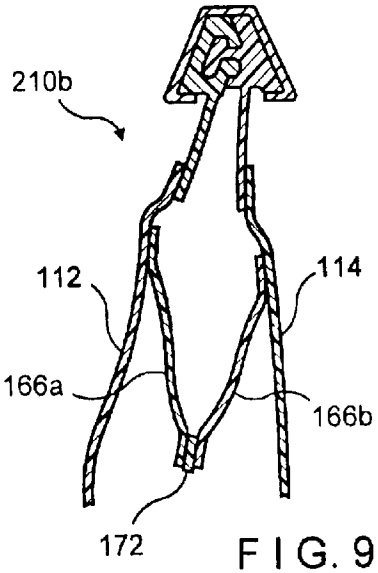
FIGS. 8–14 are alternative fragmentary sectional views taken off FIG. 7 in the direction indicated by the arrows.

Reference is now made to the drawings wherein similar elements bear the same reference numerals throughout the several views. In FIGS. 1–6 a first embodiment of the package 110 of the present invention is depicted in several alternative configurations. The package 110 is in the form of a package having a front wall 12 and a rear wall 14 that is opposite to the front wall. The package further has a bottom end 16, a top end 18 and sides 20,22. A zipper 24 is provided at the package top. A slider 26 is provided on the zipper to facilitate its opening and closing. To this end, moving the zipper slider toward one side 22 disengages the interlocking elements of the zipper profiles and moving the slider toward the opposite side 20 brings the interlocking elements of the zipper profiles into engagement.

Referring to FIGS. 2–6, it can be seen that the zipper 24 consists of a first profile 28 and a second profile 30. Profile 28 is provided with a first interlocking member 32 and profile 30 is provided with a second interlocking member 34 that is engageable with the first interlocking element 32. Numerous configurations for the interlocking members 32, 34 are well known in the art. Profile 28 further includes a flange 36 that extends toward the interior of the package and profile 30 includes a similar flange 38. In accordance with this first embodiment of the present invention each of the flanges 36, 38 is attached to its associated package wall 12,14 by a "hard" seal, 40, 42 that is a seal that is not intended to be broken. Further, each of the package walls 12, 14 includes a portion 44, 46 that extends past over the seal points 40, 42. The portions 44, 46 extend over the zipper and are joined by a seal 48 so as to form a header that encloses the zipper 24 and slider 26.

In the embodiment of FIG. 2, the seal 48 of package 110*a* is a peel seal that may readily be ruptured by a consumer to expose the zipper 24 and slider 26. To facilitate opening, the free edges of the walls may extend beyond the peel seal. In the embodiment of FIG. 3, the seal 50 of package 110*b* is a strip of peel seal material connected to both portions 44 and 46. Whereas the peel seal 48 separates from one of the portions 44, and status on the other portion 46 as the package 110*a* is initially opened, the peel strip 50 remains attached to each of the portions 44,46 and splits apart as the package 110*b* is initially opened. Added protection for the contents 52 of the package 110*c* may be obtained by joining the walls 12,14 together by a peel seal 54 below the flanges 36, 38 as shown in FIG. 4. In that way, even after the extended wall portions 44 and 46 are separated and the zipper opened, the contents of the package are protected until the seal 54 is broken. Such a feature would be necessary where it is required that the package contents be hermetically sealed below the zipper. The package 110*d* has a "hard" seal 56 joining the extended wall portions 44 and 46. In this case, the header of package 110*d* is provided with one or more lines of perforations 58 which must be torn open by a consumer to obtain access to the slider 26. In place of a line of perforations (or to facilitate tearing the perforations) one or more notches 60 may be provided at a side edge of the header to start a tear across the header.

The walls 12, 14 of the package 110*e* of FIG. 6 terminate substantially at the hard seals 40, 42 joining the walls to flanges 36, 38. In this embodiment the header is formed by extensions 62, 64 of flanges 36,38. The extensions 62, 64 may be joined by a peel seal, peel strip or a hard seal as described above. If hard seal is used to join the flanges a line of perforations or a notch may be used to facilitate opening the header. In any event, the header must be opened before access can be had to the slider and zipper.

In FIGS. 7–17 a package 210 of a second embodiment of the present invention is depicted. The package 210 includes a front and rear wall, 112 and 114, a bottom 116, top 118 and sides 120 and 122. A zipper 124 extends across the package top 118 from side to side of the package. A slider 126 is mounted on the zipper 124 for movement between a closed position and an open position. The zipper is formed as the zipper of the first embodiment and hence need not be repeated. In accordance with this second embodiment the contents 152 of package 210 are protected from tampering by a sealing strip in the form of a web of material that extends across the package from side 120 to side 122 between the walls 112, 114 below the zipper.

Figure 8:
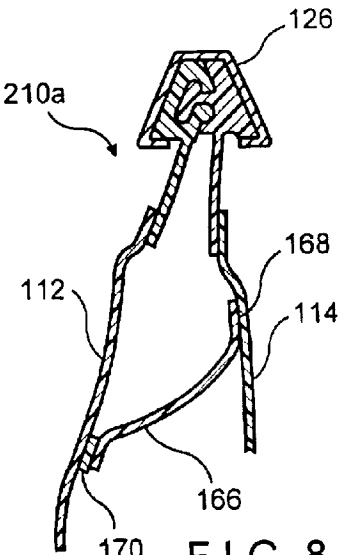

The package 210*a* of FIG. 8 has a web 166 hard sealed at 168 to wall 114 and secured to wall 112 by peel seal 170. After the slider 126 is moved to initially open the package 210*a*, the consumer presses on web 166 to rupture the peel seal and provide access to the package contents. The package 210*b* of FIG. 9 has two webs segments 166*a* and 166*b* hard sealed respectively to walls 112 and 114. The free edges of web segments 166*a* and 166*b* are sealed to each other by peel seal 172. Peel seal 172 must be ruptured before access may be had to the package contents.

Figure 11:
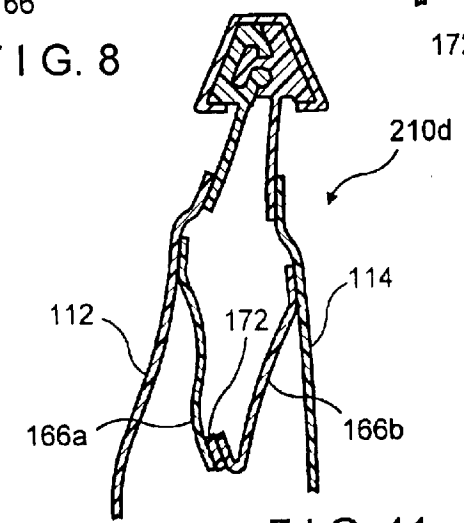
Figure 7:
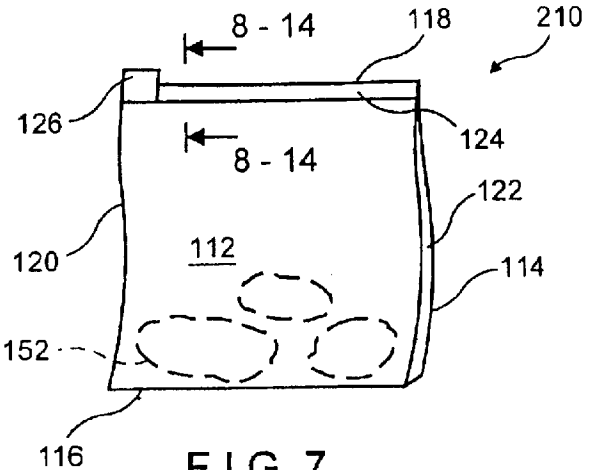
FIG. 7 is a front perspective view of a second embodiment of a package in accordance with the present invention.
Figure 10:
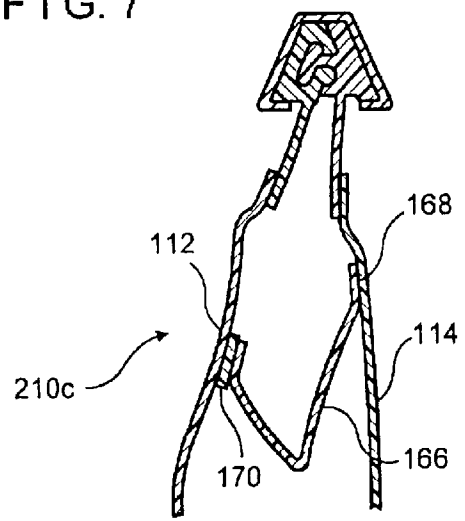

Package 210*c* of FIG. 10 is similar to the package of FIG. 8 except that the web is longitudinally folded to form a cusp directed toward the package interior. This increases the internal force that the peel seal 170 securing the web 166 to wall 112 can withstand. The package 210*d* of FIG. 11 is similar to package 210*b* of FIG. 9 except that one of the web segments 166*b* is longitudinal folded and the peel seal 172 is offset from the fold. This also improves the internal force that the peel seal can withstand.

Figure 13:
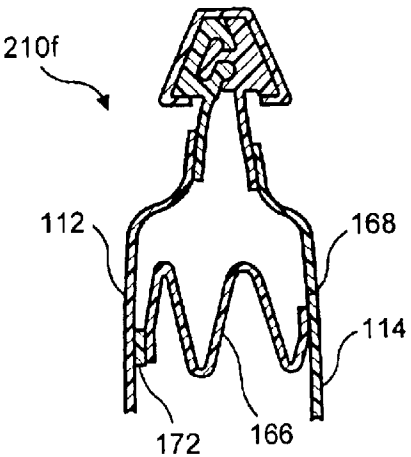
Figure 12:
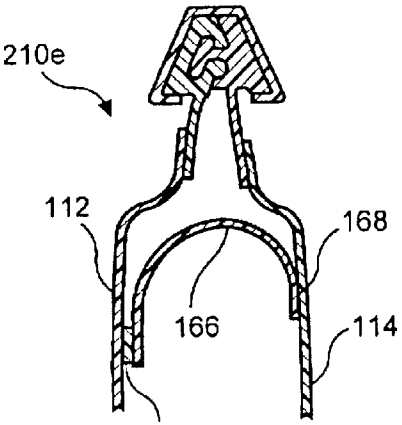
Figure 17:
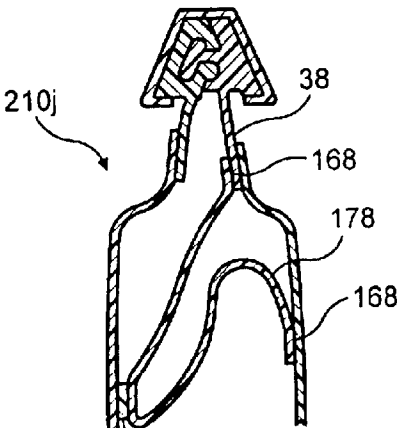
FIGS. 16 and 17 are alternative fragmentary sectional views taken off FIG. 15 in the direction indicated by the arrows.
Figure 16:
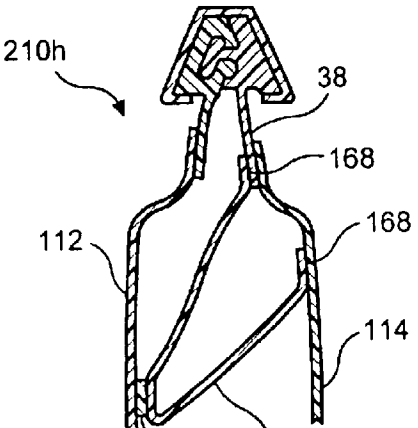
Figure 15:
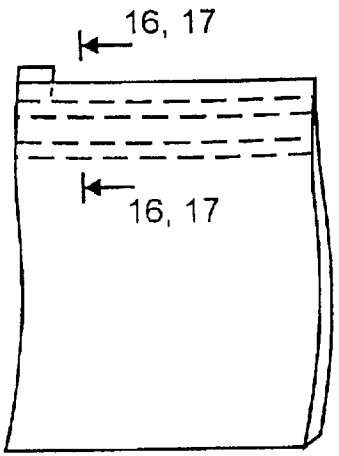
FIG. 15 is a front perspective view of a modification of the second embodiment of a package in accordance with the present invention.

Various other sealing arrangements and configurations of the web may be used to enhance the internal opening force resistance of the web peel seal. The package 210*e* of FIG. 12 has a web 166 bowed away from the product. One edge of web 166 is hard sealed to wall 114 and the opposite edge of web 166 is joined by a peel seal 172 to wall 112. The web 166 of package 210*f* of FIG. 13 is loosely fan-folded toward and away from the product. One edge of web 166 is hard sealed to wall 114 and the opposite edge of web 166 is joined by a peel seal 172 to wall 112. In both of these cases the peel seal must be ruptured to detach the web 166 from wall 112 to provide access to the product. The package 210*h* of FIG. 16 has the edges of web 166 hard sealed at locations 168 to wall 114 and flange 38 of zipper profile 30, which in turn is hard sealed to wall 114. A mid-section of web 166 is sealed to wall 112 by peel seal 172. Similarly the package 210*j* has the edges of web 166 hard sealed at two locations 168 to wall 114 and flange 38 of zipper profile 30, is sealed to the end of web 186 which in turn is hard sealed to wall 114. The other end of web 166 is hard sealed a second time to wall 114. A mid-section of web 166 is sealed to wall 112 by peel seal 172. The partial loop 178 between the wall hard seal and peel seal further improves internal opening force resistance.

Figure 14:
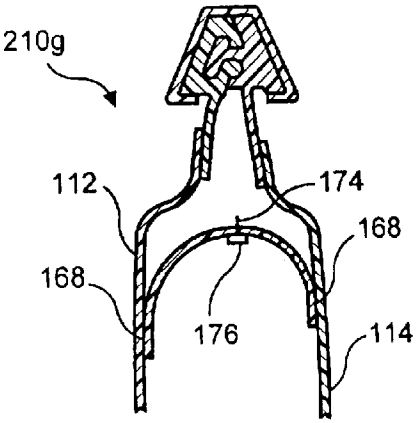

The web 166 of package 210*g* of FIG. 14 has its edges hard sealed to both wall 112 and wall 114. A weakened line 174 extend longitudinally along the approximate center of web 166 web. The weakened line may be a score line or a line of perforations. When the zipper is first opened by the slider the consumer must rupture line 174 to gain initial access to the package contents. If the package requires that the contents be hermetically sealed, the line of perforations may be capped by a strip 176.

Figure 18:
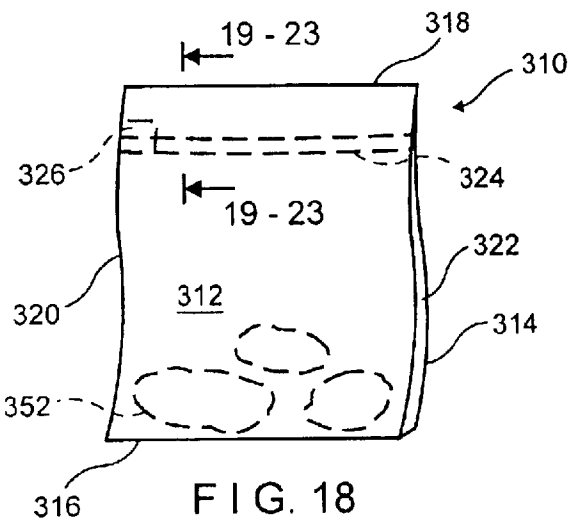
FIG. 18 is a front perspective view of a third embodiment of a package in accordance with the present invention.

In FIGS. 18–25 a package 310 of a third embodiment of the present invention is depicted in FIG. 18 wherein the zipper and slider 26 are contained within a header 178 that is added to the package. The package 310 includes a front and rear wall, 312 and 314, a bottom 316, top 318 and sides 320 and 322. A zipper 324 extends across the package top 318 from side to side of the package. A slider 326 is mounted on the zipper 324 for movement between a closed position and an open position. The zipper is formed as the zipper of the first embodiment and hence need not be repeated. In accordance with this third embodiment the contents 352 of package 310 are protected from tampering by the header 378 that extends across the top of the package.

The header must be removed or ruptured to provide initial access to the zipper.

Figure 19:
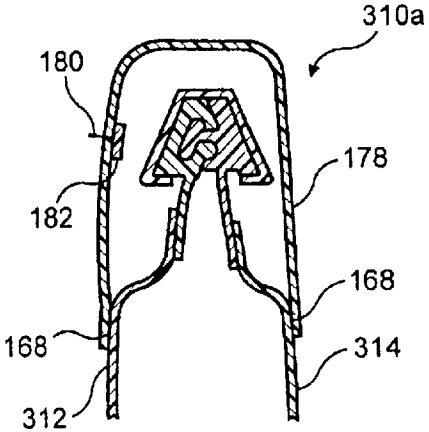
FIGS. 19–23 are alternative fragmentary sectional views taken off FIG. 18 in the direction indicated by the arrows.
Figure 20:
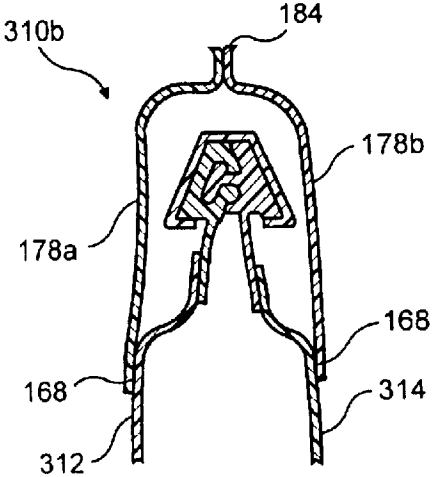
Figure 21:
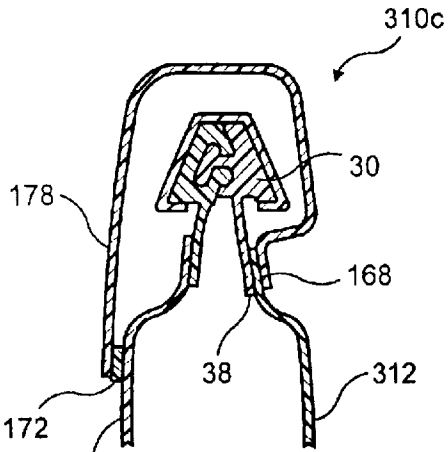

In FIG. 19 a package is depicted wherein the header 178 comprises a strip of material hard sealed to the front wall 312 and rear wall 314 at seals 168 that run from side to side of the package. A weakened line 180 extends along the strip. Line 180 may comprise a score line or line of perforations. If the package 310 needs to be sealed below the header the perforations may be capped with a strip 182. In FIG. 20 a package 310*b* is depicted wherein the header is formed of two segments 178*a* and 178*b*. One edge of segment 178*a* is hard sealed to front wall 312 and one edge of segment 178*b* is hard sealed to rear wall 314. The opposite edges of the segments 178*a* and 178*b* are peel sealed to each other. In FIG. 21 a package 310*c* is depicted wherein one edge of the header 178 is hard sealed to wall 312 which in turn is sealed to flange 38 of profile 30 and the other edge is peel sealed at 172 to bag wall 314.

Figure 22:
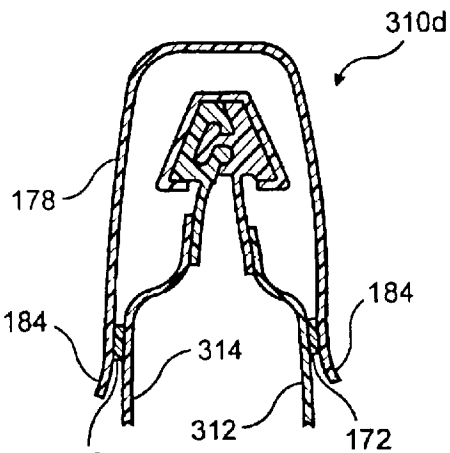
Figure 23:
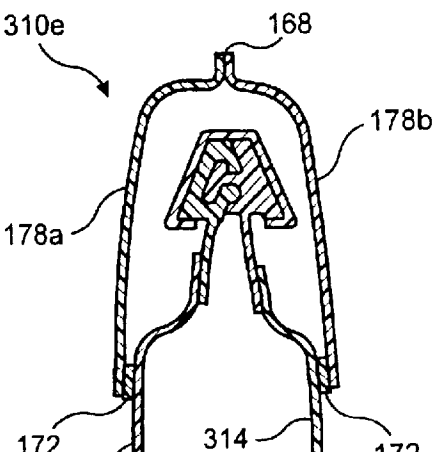

The bag 310*d* depicted in FIG. 22 has one side of header 178 peel sealed to bag wall 312 and the opposite side of the header peel sealed to bag wall 314. On both sides a flap 184 of the header extends beyond the peel seal 172 to provide a convenient finger grip for the consumer to facilitate removal of the header from the package. The package 310*e* depicted in FIG. 23 has a header formed of two segments 178*a* and 178*b* each having one of their edges sealed to the bag walls 312 and 314, respectively by peel seals 172. The other edges of the header opposite to the peel seals are hard sealed to each other. In each of the above embodiments the consumer is prevented from accessing the slider until the header is first removed. If the header is removed, it would be readily apparent that the package has been rendered capable of being opened.

Figure 24:
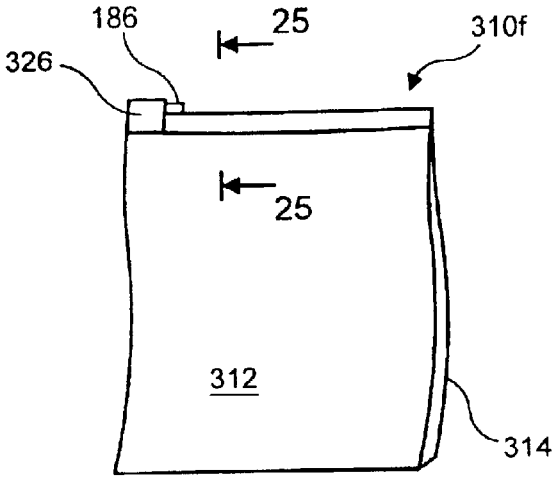
FIG. 24 is a front perspective view of a modification of the fifth embodiment of a package in accordance with the present invention.
Figure 25:
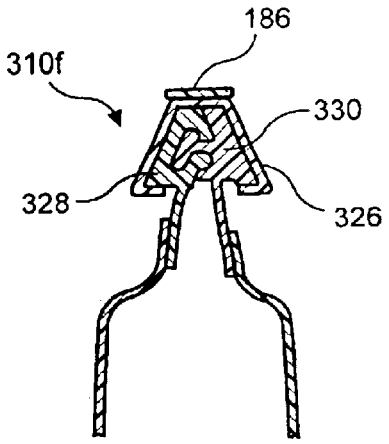
FIG. 25 is a fragmentary sectional view taken off FIG. 24 in the direction indicated by the arrows.

In FIGS. 24 and 25 a modification of the package of the fifth embodiment is depicted wherein the package 310*f* has a strip of material 186 peel sealed to the tops of profiles 328 and 330. The strip 186 is of sufficient thickness to prevent the slider 26 from being moved until the strip 186 is removed. As shown in FIG. 24 the slider 26 is at the extreme closed end of the zipper and strip 186 is immediately adjacent to the slider on the opening side of the slider. Until strip 186 is removed from the path of slider 326 the slider is prevented from moving to open package 310*f*.

Figure 26:
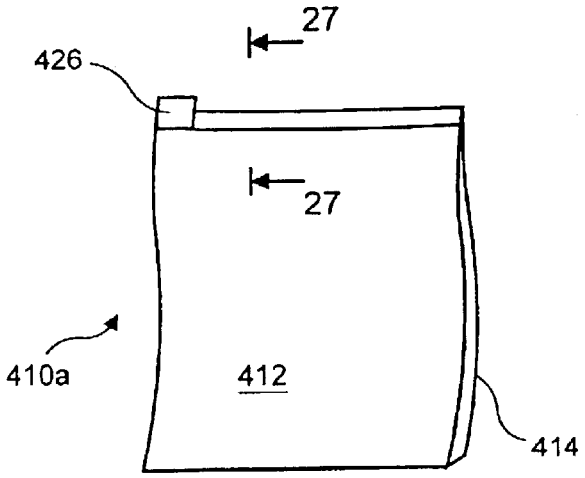
FIG. 26 is a front perspective view of a fourth embodiment of a package in accordance with the present invention.
Figure 27:
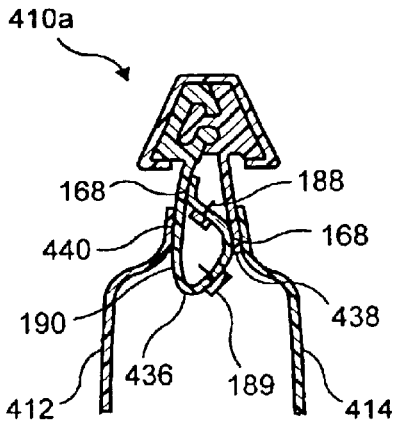
FIG. 27 is a fragmentary sectional view taken off FIG. 26 in the direction indicated by the arrows.

In FIGS. 26 and 27 a package 410*a* of a fourth embodiment of the present invention is depicted in FIG. 26 wherein one profile flange 436 is folded toward the interlocking members. The flange 436 is hard sealed to wall 412 at hard seal 440. An extension 190 of flange 436 extends beyond hard seal 440 to the opposite profile flange 438 and to itself below the interlocking members. The extension 190 is hard sealed to profile flange 438 and to itself at hard seals 168 thereby sealing off the package contents. A first series of perforations 188 is provided on the portion of extension 190 between the hard seals 168. A second series of perforations 189 is provided on the portion of extension 190 between the hard seal 440 to wall 312 and the hard seal to flange 438. In order to gain access to the package contents, both of the perforation lines must be ruptured providing clear evidence of the initial opening of the package.

Figure 30:
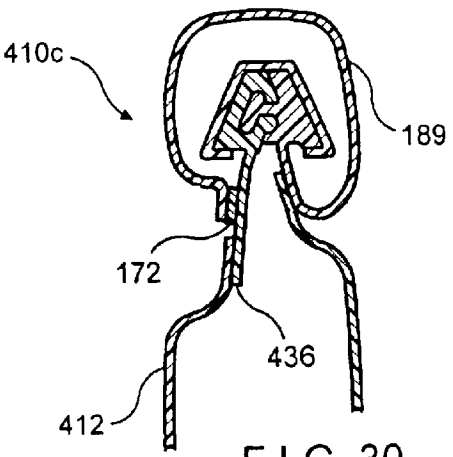
FIGS. 29 and 30 are alternative fragmentary sectional views taken off FIG. 28 in the direction indicated by the arrows.
Figure 29:
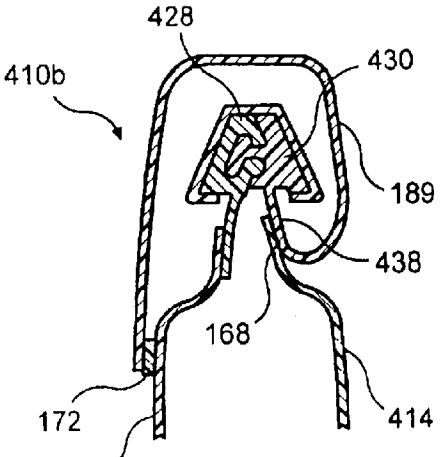
Figure 28:
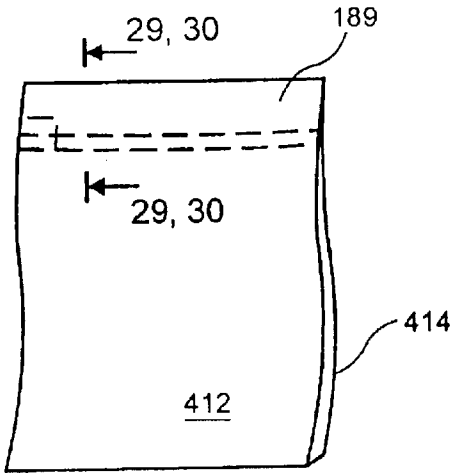
FIG. 28 is a front perspective view of a modification of the fourth embodiment of a package in accordance with the present invention.
Figure 34:
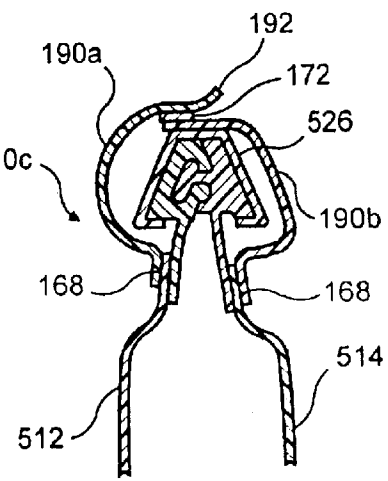
FIGS. 32–34 are alternative fragmentary sectional views taken off FIG. 31 in the direction indicated by the arrows.
Figure 33:
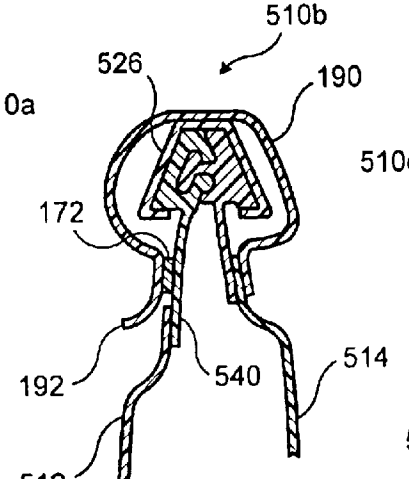
Figure 32:
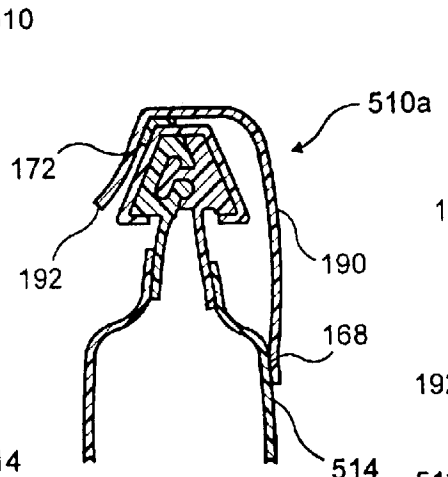

In FIGS. 28–30 a modification of the package of the fourth embodiment is depicted in FIG. 28 wherein the package 410 has one profile flange folded over the profiles' interlocking members rather than beneath the profiles' interlocking members. In FIG. 29 package 410*b* has flange 438 hard sealed to wall 414. Flange extension 189 extends beyond the hard seal 168 and over the tops of the profiles 428, 430. A peel seal 172 secures the free edge of extension 189 to the outside of package wall 412. The construction of package 410*c* of FIG. 30 is similar to that of package 410*b* except that the peel 172 secures the free edge of extension 189 to flange 436 of profile 430, above the hard seal securing profile 430 to bag wall 412. In both of these embodiments the flange extension 189 forms a header within which the slider is initially contained. To open the package for the first time, the consumer must remove the header by rupturing the peel seal.

Figure 31:
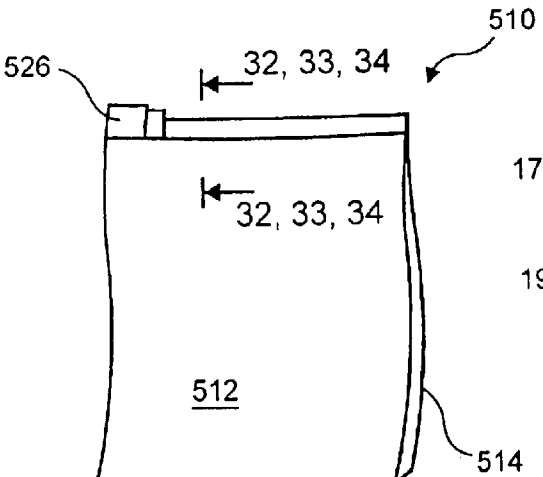
FIG. 31 is a front perspective view of a fifth embodiment of a package in accordance with the present invention.

In FIGS. 31–34 a package 510 of a fifth embodiment of the present invention is depicted in FIG. 31 wherein a flap is provided to hold the slider in a closed zipper position and prevent its movement to the open position. If the seal holding the flap is broken, the slider is freed to move to the open position. In the package 510*a* of FIG. 32 the flap 190 is secured by a hard seal 168 to bag wall 514 behind the closing end of the slider 526. The flap extends up and over the interlocked profiles and is secured to the profiles by a peel seal 172. An unsecured tab 192 extends beyond the peel seal to the free end of flap 190. When the flap is in position it prevents the slider from moving in the opening direction from the zipper fully closed position. A consumer may free the flap 190 from the profiles by pulling up on the tab 192 to break peel seal 172 and thereby render the slider free to be moved to the zipper open position. However, doing so is readily apparent by virtue of the unsecured flap. The package 510*b* of FIG. 33 has flap 190 secured by peel seal 172 to flange 540 above the point at which the flange 540 is secured to package wall 512. Again the flap is positioned behind the closing end of the slider so as to prevent the slider from moving from the initial zipper closed position. The package 510*c* of FIG. 34 has a first flap segment 190*a* secured to bag wall 512 and a second flap segment 190*b* secured to bag wall 514 with each secured by hard seals 168 and extending over the top of the interlocked profiles. The free end of flap segment 190*a* is positioned on top of the free end of flap segment 190*b* and held in position peel seal 172. Again, the flap serves to prevent movement of slider 526 off its initial fully closed. If the flap segments are separated by a consumer pulling up on tab 192, which extends from the free end of flap segment 190*a*, the path of the slider is cleared so that the slider is then free to be moved.

Thus, in accordance with the above the several desired objects and advantages of the present invention are effectively attained. Wile several embodiments of the present invention are depicted and described herein further modifications may become apparent to those skilled in the art without departing from the scope of the invention as set forth in the accompanying claims.

What is claimed is:

1. A reclosable package having a lop, bottom, and sides, said package comprising:

a first wall and a second wall opposite to said first wall; a first zipper profile having a first interlocking member and a first flange portion, said first flange portion having a first proximal end, a first distal end, and a first medial area between said first proximal end and said first distal end, said first proximal end being attached to said first interlocking member and said first medial area being sealed to said first wall along a first attachment line extending substantially from side to side of said package, said first distal end and said first proximal end being free of attachment to said first wall;

a second zipper profile having a second interlocking member and a second flange portion, said second flange portion having a second proximal end, a second distal end, and a second medial area between said second proximal end and said second distal end, said second proximal end being attached to said second interlocking member and said second medial area being sealed to said second wall along a second attachment line extending substantially from side to side of said package, said second distal end and said second proximal end being free of attachment to said second wall; and said first flange portion including a first segment formed between said first attachment line and said first distal end, said second flange portion including a second segment formed between said second attachment line and said second distal end, said first and second segments extending over said first and second interlocking members, respectively, to a peel seal joining to first distal end with said second distal end.

2. The reclosable package in accordance with claim 1 further comprising a slider disposed upon said interlocking members for movement from side to side of said package between a zipper fully open and a zipper fully closed position, said first and second segments extending over said slider.

* * * * *